US010434623B2

(12) United States Patent
Lau et al.

(10) Patent No.: US 10,434,623 B2
(45) Date of Patent: Oct. 8, 2019

(54) LOCAL AREA POLISHING SYSTEM AND POLISHING PAD ASSEMBLIES FOR A POLISHING SYSTEM

(71) Applicant: Applied Materials, Inc., Santa Clara, CA (US)

(72) Inventors: Eric Lau, Santa Clara, CA (US); Hui Chen, Burlingame, CA (US); King Yi Heung, Union City, CA (US); Wei-Cheng Lee, Los Altos Hills, CA (US); Chih Chung Chou, San Jose, CA (US); Edwin C. Suarez, Fremont, CA (US); Garrett Ho Yee Sin, San Jose, CA (US); Charles C. Garretson, Sunnyvale, CA (US); Jeonghoon Oh, Saratoga, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 15/456,320

(22) Filed: Mar. 10, 2017

(65) Prior Publication Data

US 2017/0274497 A1 Sep. 28, 2017

Related U.S. Application Data

(60) Provisional application No. 62/313,388, filed on Mar. 25, 2016.

(51) Int. Cl.
*B24B 37/26* (2012.01)
*B24B 37/30* (2012.01)

(52) U.S. Cl.
CPC ..... *B24B 37/26* (2013.01); *B24B 37/30* (2013.01)

(58) Field of Classification Search
CPC ..... B24B 37/26; B24B 37/30
See application file for complete search history.

(56) References Cited

U.S. PATENT DOCUMENTS 5,759,918 A * 6/1998 Hoshizaki ..... B24B 7/241 438/692
5,840,202 A * 11/1998 Walsh ..... B24B 53/017 216/52
5,931,719 A 8/1999 Nagahara et al.
5,934,979 A * 8/1999 Talieh ..... B24B 21/004 451/271

(Continued)

FOREIGN PATENT DOCUMENTS

JP 4675803 B2 4/2011

OTHER PUBLICATIONS

International Search Report and Written Opinion for Application No. PCT/US2017/019263 dated May 30, 2017.

*Primary Examiner* — Marc Carlson
(74) *Attorney, Agent, or Firm* — Patterson + Sheridan LLP

(57) ABSTRACT

A polishing module including a chuck having a substrate receiving surface and a perimeter, and one or more polishing pad assemblies positioned about the perimeter of the chuck, wherein each of the one or more polishing pad assemblies are coupled to an actuator that provides movement of the respective polishing pad assemblies in one or more of a sweep direction, a radial direction, and a oscillating mode relative to the substrate receiving surface and are limited in radial movement to about less than one-half of the radius of the chuck as measured from the perimeter of the chuck.

19 Claims, 8 Drawing Sheets

(56) References Cited

U.S. PATENT DOCUMENTS 6,165,057 A 12/2000 Gill, Jr.
6,296,550 B1 * 10/2001 Liu ..... B24B 37/11 451/287
6,413,388 B1 * 7/2002 Uzoh ..... B23H 5/08 204/224 M
6,439,979 B1 * 8/2002 Beppu ..... B24B 37/12 451/285
6,520,843 B1 * 2/2003 Halley ..... B24B 9/065 451/285
6,857,946 B2 * 2/2005 Zuniga ..... B24B 37/32 451/177
7,520,939 B2 * 4/2009 Ho ..... B08B 3/02 134/26
7,993,485 B2 * 8/2011 Wasinger ..... B24B 1/04 156/345.12
8,133,096 B2 * 3/2012 Emami ..... B24D 7/14 451/285
8,142,260 B2 * 3/2012 Kollata ..... H01L 21/02087 451/168
9,180,570 B2 * 11/2015 Kerprich ..... B24B 37/26
2001/0000497 A1 * 4/2001 Epshteyn ..... B24B 37/013 438/691
2002/0033230 A1 * 3/2002 Hayashi ..... B24B 37/30 156/345.12
2002/0132566 A1 * 9/2002 Jeong ..... B24B 37/30 451/57
2005/0221721 A1 * 10/2005 Valle ..... B24B 13/0052 451/11
2007/0149096 A1 * 6/2007 Nishimura ..... B24B 37/26 451/41
2008/0102737 A1 * 5/2008 Chang ..... B24B 53/017 451/56
2009/0081932 A1 * 3/2009 O'Moore ..... B24B 37/26 451/490
2010/0035526 A1 * 2/2010 Tolles ..... B08B 1/007 451/57
2012/0190281 A1 * 7/2012 Allison ..... B24B 37/26 451/527
2012/0282849 A1 * 11/2012 Kerprich ..... B24B 37/005 451/527
2013/0137350 A1 * 5/2013 Allison ..... B24B 37/16 451/539
2013/0288578 A1 * 10/2013 Chen ..... B24B 37/107 451/59
2014/0206268 A1 * 7/2014 Lefevre ..... B24B 37/22 451/529
2015/0111478 A1 * 4/2015 Chen ..... B24B 37/10 451/72
2015/0352686 A1 * 12/2015 Wu ..... B24B 49/04 438/14
2016/0005618 A1 * 1/2016 Chen ..... B24B 37/10 451/41
2016/0016281 A1 * 1/2016 Chen ..... B24B 37/10 156/345.12

* cited by examiner

LOCAL AREA POLISHING SYSTEM AND POLISHING PAD ASSEMBLIES FOR A POLISHING SYSTEM

CROSS-REFERENCE TO RELATED APPLICATION

This application claims benefit of U.S. Provisional Patent Application Ser. No. 62/313,388, filed Mar. 25, 2016, which is incorporated by reference herein.

BACKGROUND

Field

Embodiments of the present disclosure generally relate to methods and apparatus for polishing a substrate, such as a semiconductor wafer. More particularly, to methods and apparatus for polishing local areas of a substrate in an electronic device fabrication process.

Description of the Related Art

Chemical mechanical polishing is one process commonly used in the manufacture of high-density integrated circuits to planarize or polish a layer of material deposited on a substrate by moving a feature side, i.e., a deposit receiving surface, of the substrate in contact with a polishing pad while in the presence of a polishing fluid. In a typical polishing process, the substrate is retained in a carrier head that urges or presses the backside of the substrate toward a polishing pad. Material is removed globally across the surface of the feature side of the substrate that is in contact with the polishing pad through a combination of chemical and mechanical activity.

The carrier head may contain multiple individually controlled pressure regions that apply differential pressure to different regions of the substrate. For example, if greater material removal is desired at peripheral edges of the substrate as compared to the material removal desired at the center of the substrate, the carrier head may be used to apply more pressure to the peripheral edges of the substrate. However, the stiffness of the substrate tends to redistribute the pressure applied to local regions of the substrate by the carrier head such that the pressure applied to the substrate may be spread or smoothed generally across the entire substrate. The smoothing effect makes local pressure application, for local material removal, difficult if not impossible.

Therefore, there is a need for a method and apparatus that facilitates removal of materials from local areas of the substrate.

SUMMARY

Embodiments of the present disclosure generally relate to methods and apparatus for polishing local areas of a substrate, such as a semiconductor wafer. In one embodiment, a polishing module is provided. The polishing module includes a chuck having a substrate receiving surface and a perimeter, and one or more polishing pad assemblies positioned about the perimeter of the chuck, wherein each of the one or more polishing pad assemblies are coupled to an actuator that provides movement of the respective polishing pad assemblies in one or more of a sweep direction, a radial direction, and a oscillating mode relative to the substrate receiving surface and are limited in radial movement to about less than one-half of the radius of the chuck as measured from the perimeter of the chuck.

In another embodiment, a polishing module is provided. The module includes a chuck having a substrate receiving surface and a perimeter, a polishing head disposed about the perimeter, and a polishing pad assembly disposed in a housing that is coupled to the polishing head, wherein each of the polishing heads are coupled to an actuator that provides movement of the respective polishing pad assemblies in a sweep direction and a radial direction that is less than about one-half of a radius of the chuck, and the polishing head includes an actuator assembly that provides oscillating movement between the polishing pad assembly and the housing.

In another embodiment, a polishing module is provided. The module includes a chuck having a substrate receiving surface and a perimeter, and a plurality of polishing heads positioned about the perimeter of the chuck, each of the polishing heads coupled to a respective housing having a polishing pad assembly disposed thereon, wherein each of the polishing heads are coupled to an actuator that provides movement of the respective polishing pad assemblies in a sweep direction and a radial direction that is less than about one-half of a radius of the chuck, and the polishing head includes a motor that is coupled to a shaft and a rotor that provides oscillating movement between the polishing pad assembly and the housing, at least one of the polishing heads is arc-shaped, and at least one of the polishing pad assemblies is circular or polygonal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the disclosure provide a polishing module utilized to polish local areas of a substrate. Benefits of the disclosure include improved local polishing control with limited dishing and/or erosion in the local areas. Embodiments of the polishing module as described herein may remove a material thickness of about 20 Angstroms (Å) to about 200 Å on a substrate, and in some embodiments, a material thickness of about 10 Å to about 200 Å may be removed. In some embodiments, the material may be removed with an accuracy of about +/−5 Å. Embodiments described herein may be used to perform thickness corrections on any film or silicon on local areas of a substrate and may also be used for edge bevel polishing. A local area of a substrate may be defined as a surface area on the substrate of about 6 millimeters (mm) by about 6 mm, or greater, such as up to about 20 mm by about 20 mm. In some embodiments, the local area of a substrate may be the surface area occupied by one die.

Figure 1:
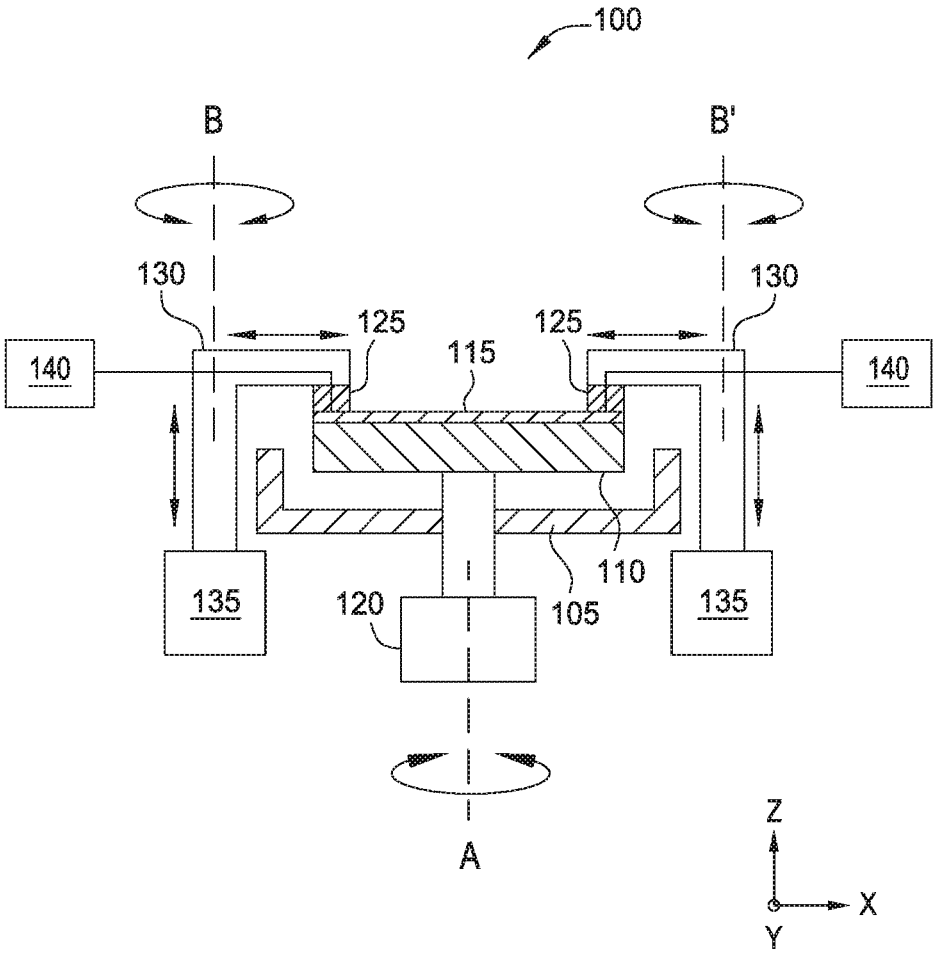
FIG. 1 is a schematic sectional view of one embodiment of a polishing module.

FIG. 1 is a schematic sectional view of one embodiment of a polishing module 100. The polishing module 100 includes a base 105 supporting a chuck 110, which rotatably supports the substrate 115 thereon. The chuck 110 may be a vacuum chuck, in one embodiment. The chuck 110 is coupled to a drive device 120, which may be a motor or actuator, providing at least rotational movement of the chuck 110 about axis A (oriented in the Z direction). The polishing module 100 may be used before a conventional polishing process or after a conventional polishing process to polish local areas of the substrate 115 and/or perform thickness corrections on the substrate 115. In some embodiments, the polishing module 100 may be used to polish and/or remove material in an area above individual die on the substrate 115.

The substrate 115 is disposed on the chuck 110 in a "face-up" orientation such that the feature side of the substrate 115 faces one or more polishing pad assemblies 125. Each of the one or more polishing pad assemblies 125 is utilized to polish or remove material from the substrate 115. The polishing pad assemblies 125 may be used to remove material from local areas of the substrate 115 and/or polish a peripheral edge of the substrate 115 before or after polishing of the substrate 115 in a conventional chemical mechanical polishing (CMP) system. The one or more polishing pad assemblies 125 comprise a commercially available CMP polishing pad material, such as polymer based pad materials typically utilized in CMP processes.

Each of the one or more polishing pad assemblies 125 are coupled to a support arm 130 that moves the polishing pad assemblies 125 relative to the substrate 115. Each of the support arms 130 may be coupled to an actuator system 135 that moves the support arm 130 (and the polishing pad assembly 125 mounted thereon) vertically (Z direction) as well as laterally (X and/or Y direction) relative to the substrate 115 mounted on the chuck 110. The actuator system 135 may also be utilized to move the support arm 130 (and the polishing pad assembly 125 mounted thereon) in an orbital, circular or oscillating motion relative to the substrate 115. The actuator system 135 may also be utilized to move the support arm 130 (and the polishing pad assembly 125 mounted thereon) about axes B and B' to provide a sweeping motion in theta directions.

In one embodiment, a polishing fluid from a fluid source 140 may be applied to the polishing pad assembly 125 and/or the substrate 115. The fluid source 140 may also provide de-ionized water (DIW) to the polishing pad assembly 125 and/or the substrate 115 in order to facilitate cleaning. The fluid source 140 may also provide a gas such as clean dry air (CDA), to the polishing pad assembly 125 in order to adjust pressure applied to the polishing pad assembly 125. The base 165 may be utilized as a basin to collect polishing fluid and/or DIW.

Figures 2A, 2B:
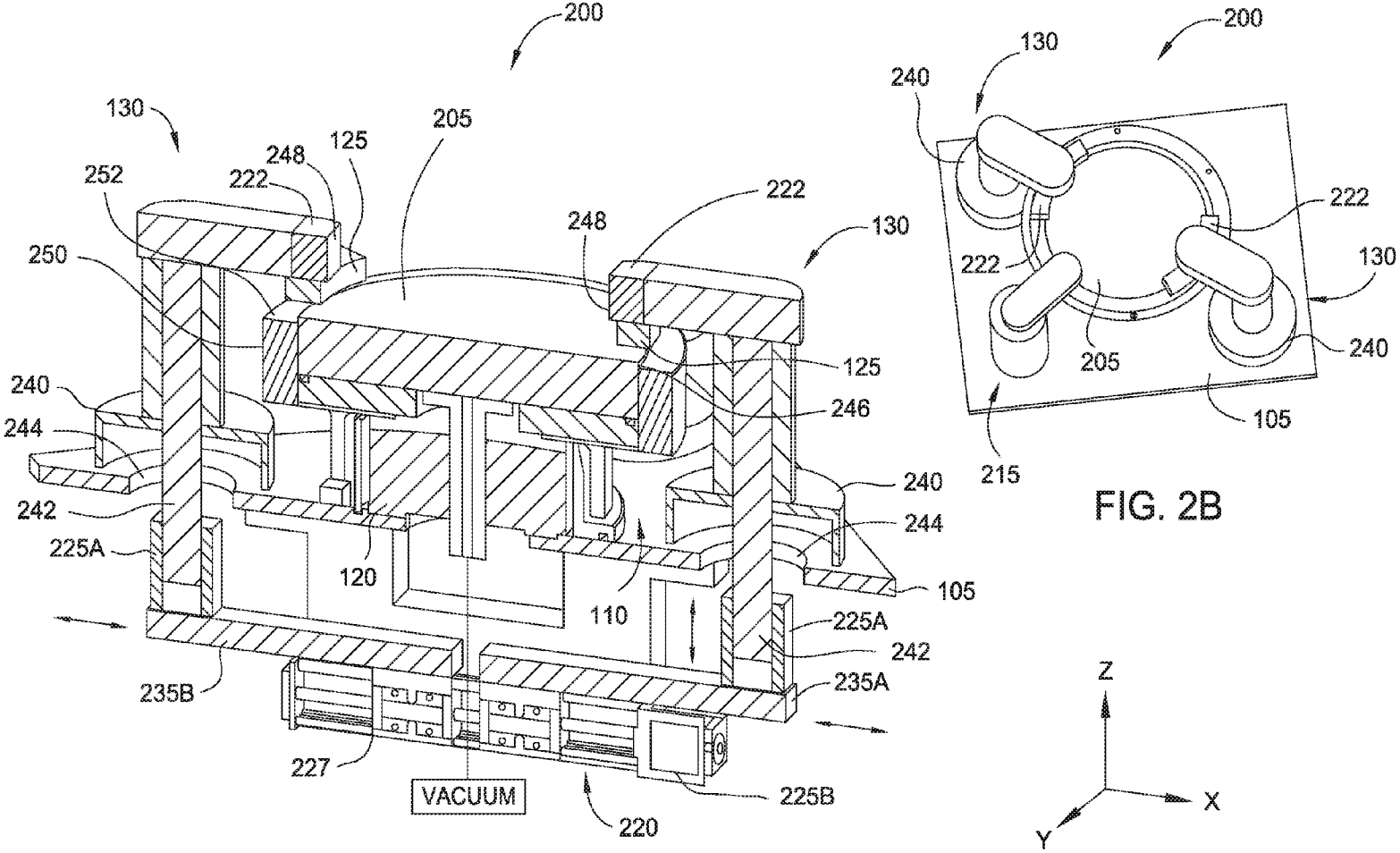
FIG. 2A is a side cross-sectional view of another embodiment of a polishing module.
FIG. 2B is an isometric top view of the polishing module shown in FIG. 2A.

FIG. 2A is a side cross-sectional view of another embodiment of a polishing module 200. FIG. 2B is an isometric top view of the polishing module 200 shown in FIG. 2A. The polishing module 200 includes the chuck 110 which in this embodiment is coupled to a vacuum source. The chuck 110 includes a substrate receiving surface 205 that includes a plurality of openings (not shown) that are in communication with the vacuum source such that a substrate (shown in FIG. 1) disposed on the substrate receiving surface 205 may be secured thereon. The chuck 110 also includes the drive device 120 that rotates the chuck 110. Each of the support arms 130 comprises a polishing head 222 that includes the polishing pad assembly 125.

A metrology device 215 (shown in FIG. 2B) may also be coupled to the base 165. The metrology device 215 may be utilized to provide an in-situ metric of polishing progress by measuring a metal or dielectric film thickness on the substrate (not shown) during polishing. The metrology device 215 may be an eddy current sensor, an optical sensor, or other sensing device that may be used to determine metal or dielectric film thickness. Other methods for ex-situ metrology feedback include pre-determining parameters such as location of thick/thin areas of deposition on the wafer, the motion recipe for the chuck 110 and/or the polishing pad assemblies 125, polishing time, as well as the downforce or pressure to be used. Ex-situ feedback can also be used to determine the final profile of the polished film. In situ metrology can be used to optimize polishing by monitoring progress of the parameters determined by the ex-situ metrology.

Each of the support arms 130 are movably mounted on the base 165 by an actuator assembly 220. The actuator assembly 220 includes a first actuator 225A and a second actuator 225B. The first actuator 225A may be used to move each support arm 130 (with the respective polishing head 222) vertically (Z direction) and the second actuator 225B may be used to move each support arm 130 (with the respective polishing head 222) laterally (X direction, Y direction, or combinations thereof). The first actuator 225A may also be used to provide a controllable downforce that urges the polishing pad assemblies 125 towards the substrate (not shown). While only 2 support arms 130 and polishing heads 222 having polishing pad assemblies 125 thereon are shown in FIGS. 2A and 2B, the polishing module 200 is not limited to this configuration. The polishing module 200 may include any number of support arms 130 and polishing heads 222 as allowed by the circumference of the chuck 110 and sufficient space allowance for the metrology device 215, as well as space for sweeping movement of the support arms 130 (with the polishing heads 222 and polishing pad assemblies 125 mounted thereon).

The actuator assembly 220 may comprise a linear movement mechanism 227, which may be a slide mechanism or ball screw coupled to the second actuator 225B. Likewise, each of the first actuators 225A may comprise a linear slide mechanism, a ball screw, or a cylinder slide mechanism that moves the support arm 130 vertically. The actuator assembly 220 also includes support arms 235A, 235B coupled between the first actuator 225A and the linear movement mechanism 227. Each of the support arms 235A, 235B may be actuated simultaneously or individually by the second actuator 225B. Thus, lateral movement of the support arms 130 (and polishing pad assemblies 125 mounted thereon) may sweep radially on the substrate (not shown) in a synchronized or non-synchronized manner. A dynamic seal 240 may be disposed about a support shaft 242 that may be part of the first actuator 225A. The dynamic seal 240 may be a labyrinth seal that is coupled between the support shaft 242 and the base 165.

The support shaft 242 is disposed in an opening 244 formed in the base 165 that allows lateral movement of the support arms 130 based on the movement provided by the actuator assembly 220. The opening 244 is sized to allow sufficient lateral movement of the support shaft 242 such that the support arms 130 (and polishing heads 222 mounted thereon) may move from a perimeter 246 of the substrate receiving surface 205 toward the center thereof to about one half the radius of the substrate receiving surface 205. In one embodiment, the substrate receiving surface 205 has a diameter that is substantially the same as the diameter of a substrate that would be mounted thereon during processing. For example, if the radius of the substrate receiving surface 205 is 150 mm, the support arms 130, particularly the polishing pad assemblies 125 mounted thereon, may move radially from about 150 mm (e.g., the perimeter 246) to about 75 mm inward toward the center, and back to the perimeter 246. The term "about" may be defined as 0.00 mm (zero mm) to no more than 5 mm past one half of the radius of the substrate receiving surface 205, which is about 75 mm in the example above.

Additionally, the opening 244 is sized to allow sufficient lateral movement of the support shaft 242 such that an end 248 of the support arms 130 may be moved past a perimeter 250 of the chuck 110. Thus, when the polishing heads 222 are moved outward to clear the perimeter 250, a substrate may be transferred onto or off of the substrate receiving surface 205. The substrate may be transferred by a robot arm or end effector to or from a conventional polishing station before or after a global CMP process.

Figure 3:
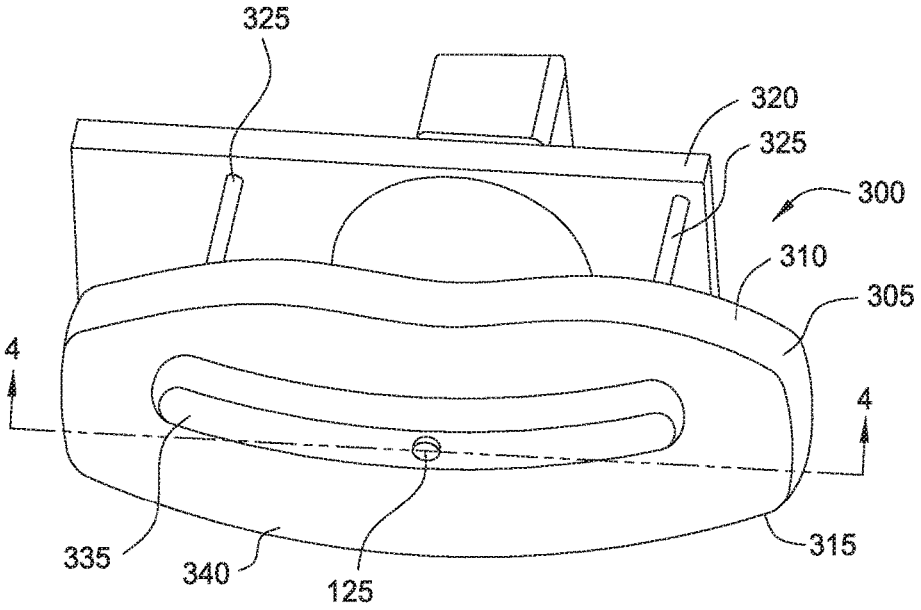
FIG. 3 is an isometric bottom view of one embodiment of a polishing head.
Figure 4:
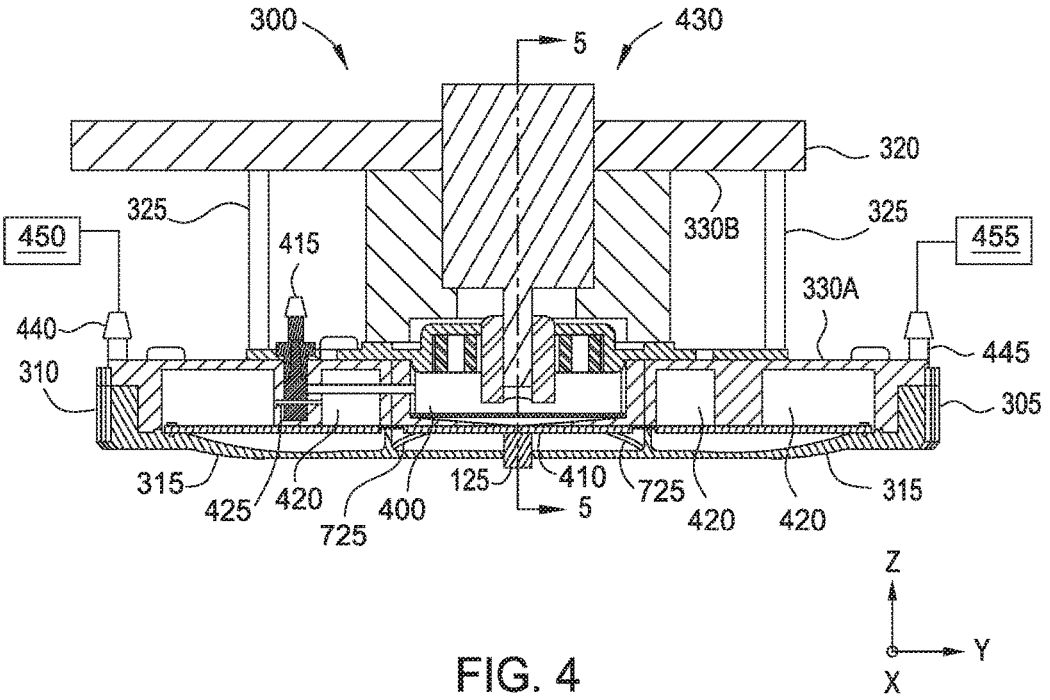
FIG. 4 is a cross-sectional view of the polishing head along line 4-4 of FIG. 3.

FIG. 3 is an isometric bottom view of one embodiment of a polishing head 300 and FIG. 4 is a cross-sectional view of the polishing head 300 along line 4-4 of FIG. 3. The polishing head 300 may be utilized as one or more of the polishing heads 222 shown in FIGS. 2A and 2B. The polishing head 300 includes a polishing pad assembly 125 movable relative to a housing 305. The polishing pad assembly 125 may be round as shown, or an oval shape, or include a polygonal shape, such as square or rectangular. The housing 305 may include a rigid wall 310 and a housing base 315 that is flexible or semi-flexible. The housing base 315 may contact a surface of a substrate and is generally compliant such that the housing base 315 flexes in response to such contact. The housing 305 as well as the housing base 315 may be made of a polymer material, such as polyurethane, PET (polyethylene terephthalate), or another suitable polymer having sufficient hardness. In some embodiments, the hardness may be about 95 Shore A, or greater. The polishing pad assembly 125 extends through an opening in the housing base 315.

Both of the housing base 315 and the polishing pad assembly 125 may be movable relative to each other during a polishing process. The housing 305 is coupled to a support member 320 that is in turn coupled to a respective support arm 130 (shown in FIGS. 1-2B). The housing 305 is laterally movable relative to the support member 320 (e.g., in the X and/or Y directions) and are coupled together by one or more flexible posts 325. The number of flexible posts 325 per polishing head 300 may be four although only two are shown in FIGS. 3 and 4. The flexible posts 325 are utilized to maintain a parallel relationship between a plane 330A of the housing 305 and a plane 3306 of the support member 320. The flexible posts 325 may be made of a plastic material, such as nylon or other flexible plastic materials. Lateral movement may be provided by friction between the housing base 315 and a surface of a substrate (not shown). However, the lateral movement may be controlled by the flexible posts 325. Additionally, lateral movement may be provided by an actuator assembly (described below) disposed in the polishing head 300.

Another degree of relative movement of the polishing pad assembly 125 may be provided by a pressure chamber 400 provided in the housing 305. The pressure chamber 400 may be bounded by a bearing cap 405 and a flexible membrane 410 coupled to the polishing pad assembly 125. Compressed fluids, such as clean dry air, may be provided to the pressure chamber 400 via a fluid inlet 415 that is in fluid communication with the pressure chamber 400 by a plenum 420 positioned laterally relative to the pressure chamber 400. The plenum 420 may be bounded by surfaces of the housing 305 and the flexible membrane 410. The volumes of the pressure chamber 400 and the plenum 420 may be fluidly separated from a volume 425 between the flexible membrane 410 and the housing base 315 such that fluids are contained therein and/or the volume 425 is at a pressure lower than a pressure of the plenum 420 (as well as the plenum 420 (e.g., at ambient or room pressure, or slightly above room pressure). Fluids provided to the plenum 420 provide a downforce to the polishing pad assembly 125 by applying a controllable force against the flexible membrane 410. The downforce may be varied as needed such that movement of the polishing pad assembly 125 is provided or controlled in the Z direction.

Another degree of relative movement of the polishing pad assembly 125 may be provided by an actuator assembly 430 disposed in the polishing head 300. For example, the actuator assembly 430 may be utilized to facilitate movement of the polishing head 300 relative to a surface of a substrate described in more detail in FIG. 5.

Figure 5:
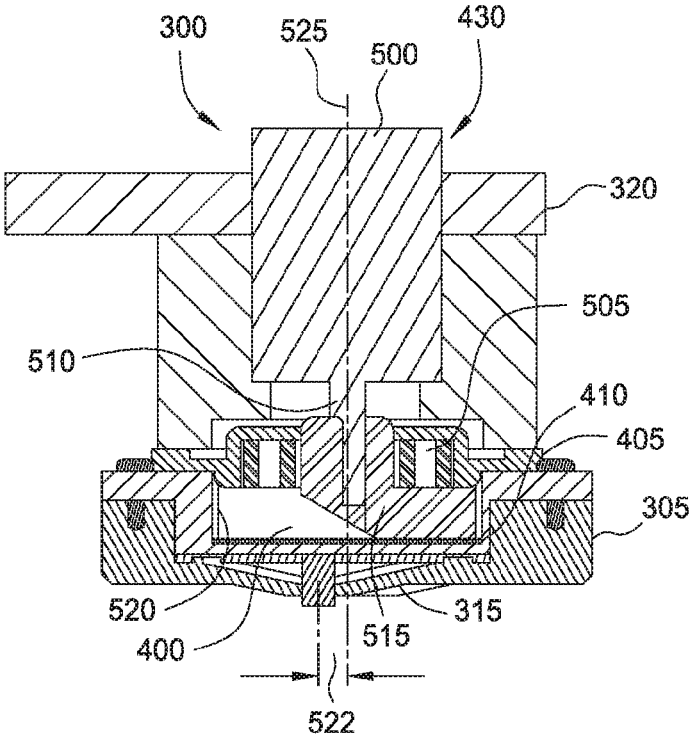
FIG. 5 is a cross-sectional view of the polishing head along line 5-5 of FIG. 4.

FIG. 5 is a cross-sectional view of the polishing head 300 along line 5-5 of FIG. 4. The actuator assembly 430 includes a motor 500 and a bearing 505 circumscribing a shaft 510. The shaft 510 is coupled to a rotor 515, and one of the rotor 515 and the shaft 510 is an eccentrically shaped member. For example, one of the shaft 510 and the rotor 515 is eccentric such that the rotor 515 intermittently contacts an interior wall 520 of the pressure chamber 400 when the shaft 510 is rotated. The eccentric motion may be a dimension 522 of about +/−1 millimeter (mm) from a centerline 525 of the motor 500. The intermittent contact may be controlled by the rotational speed of the shaft 510 (e.g., revolutions per minute of the shaft 510) during operation. The intermittent contact may move the housing 305 laterally (in the X/Y plane) during operation such that the polishing pad assembly 125 oscillates at a desired speed. The oscillation may provide additional removal of material from a surface of a substrate (not shown). The movement of the housing 305, as well as parallelism of the housing 305 with the support member 320, may be controlled by the flexible posts 325 (shown in FIG. 4).

Figure 6:
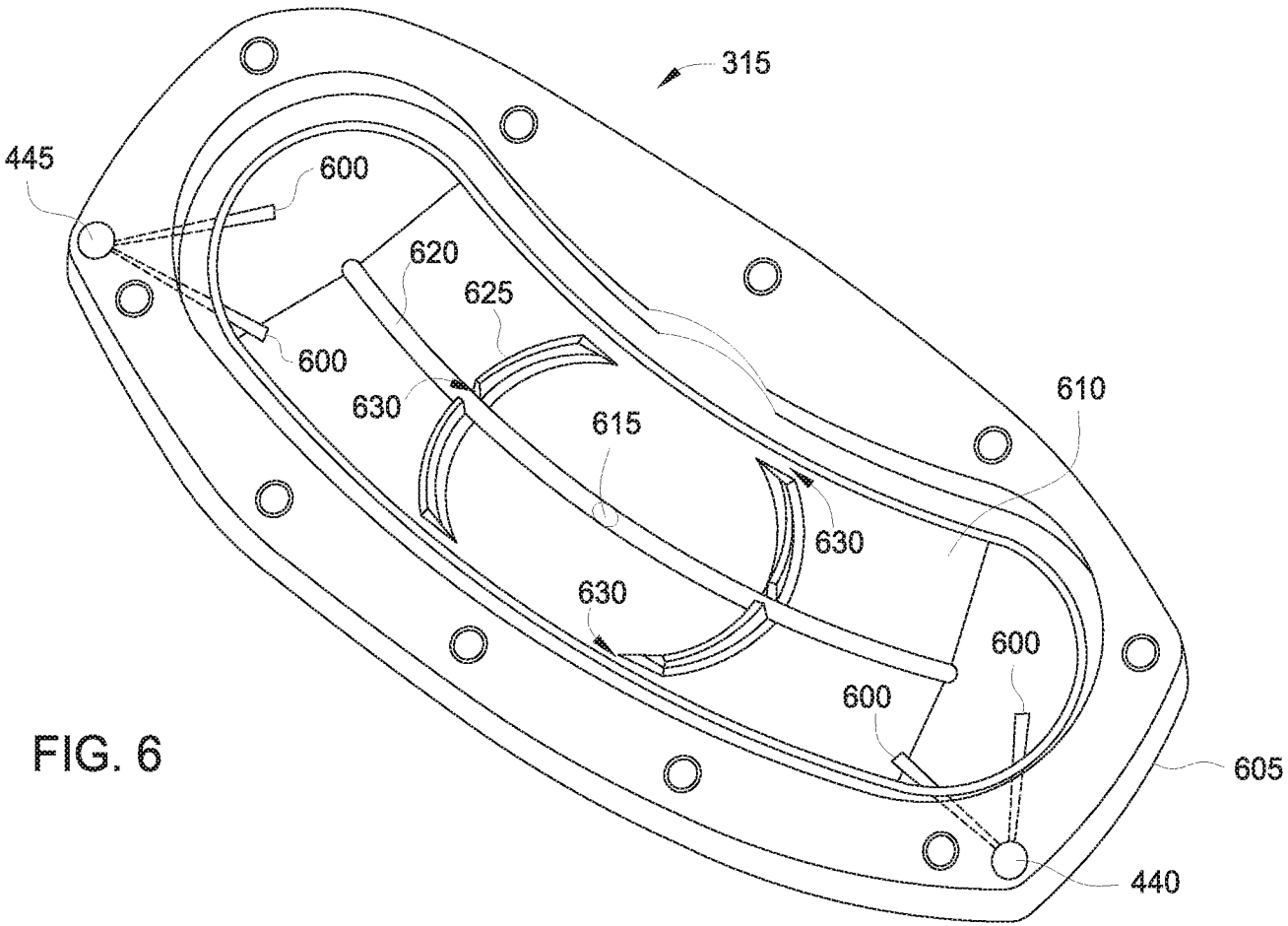
FIG. 6 is an isometric top view of the housing base of the polishing head of FIG. 3.

FIG. 6 is an isometric top view of the housing base 315 of the polishing head 300 of FIG. 3. Fluid flow within and through the housing base 315 will be explained with reference to FIGS. 3, 4 and 6.

Referring to FIG. 4, the housing 305 includes a first inlet 440 and a second inlet 445 coupled thereto. The first inlet 440 may be coupled to a water source 450, such as deionized water (DIW) and the second inlet 445 may be coupled to a polishing fluid source 455, which may be a slurry utilized in a polishing process. Both of the first inlet 440 and the second inlet 445 are in fluid communication with the volume 425 between the flexible membrane 410 and the housing base 315 by one or more channels 600 shown in FIG. 6. A portion of the channels 600 formed in a wall 605 of the housing base 315 are shown in dashed lines, but the channels 600 open into an interior surface 610 of the housing base 315.

During a polishing process, polishing fluid from the polishing fluid source 455 may be provided to the volume 425 via the second inlet 445. The polishing fluid flows through the channels 600 and into the volume 425. In some embodiments, an opening 615 is formed in the interior surface 610 of the housing base 315, the opening 615 accommodating the polishing pad assembly 125 therein. The opening 615 may be sized slightly larger than the polishing pad assembly 125 such that polishing fluid may flow through the opening 615 about the polishing pad assembly 125.

Likewise, fluid from the first inlet 440, such as DIW, may flow from the first inlet 440 to the channels 600, and to the opening 615. The fluid from the first inlet 440 may be used to clean the polishing pad assembly 125 before or after a polishing process.

In some embodiments, the housing base 315 includes a recessed portion 620 that forms a protrusion 335 that is raised from an exterior surface 340 of the housing base 315 as shown in FIG. 3. The recessed portion 620 may be a channel that facilitates fluid transportation from the channels 600 to the opening 615. The recessed portion 620 (as well as the protrusion 335) may be arc-shaped in some embodiments. In some embodiments, the housing base 315 may include baffles 625 that slow and/or controls the flow of fluids in the volume 425. Walls of the baffles 625 may extend to the flexible membrane 410 as shown in FIG. 4. The baffles 625 may include one or more openings 630 to provide fluid flow therethrough.

Figure 7:
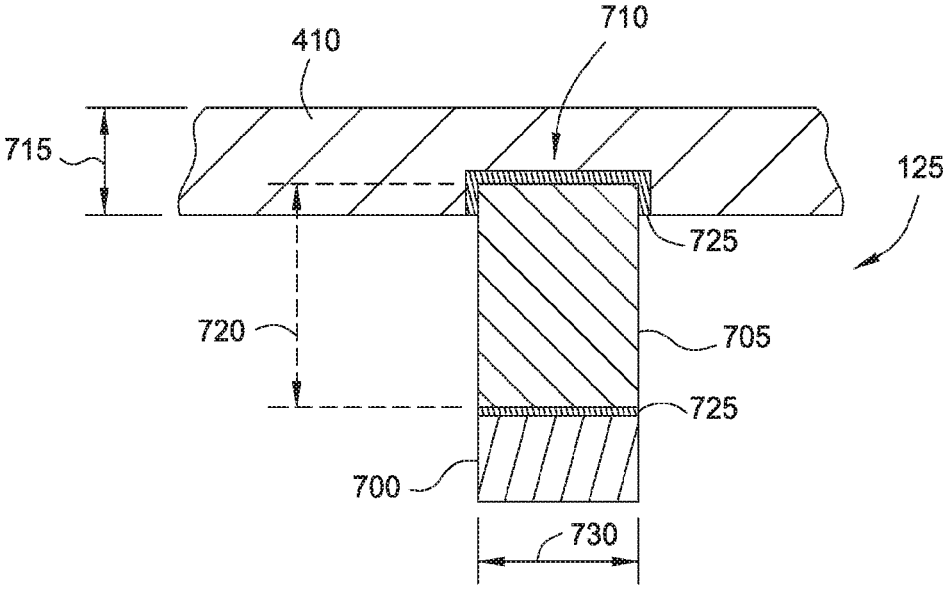
FIG. 7 is a cross-sectional view of a polishing pad assembly according to one embodiment.

FIG. 7 is a cross-sectional view of a polishing pad assembly 125 according to one embodiment. The polishing pad assembly 125 includes a first or contact portion 700 and a second or support portion 705. The contact portion 700 may be a conventional pad material, such as commercially available pad material, such as polymer based pad materials typically utilized in CMP processes. The polymer material may be a polyurethane, a polycarbonate, fluoropolymers, polytetrafluoroethylene (PTFE), polyphenylene sulfide (PPS), or combinations thereof. The contact portion 700 may further comprise open or closed cell foamed polymers, elastomers, felt, impregnated felt, plastics, and like materials compatible with the processing chemistries. In another embodiment, the contact portion 700 is a felt material impregnated with a porous coating. In another embodiment, the contact portion 700 comprises a pad material available from DOW® that is sold under the tradename IC1010™.

The support portion 705 may be a polymer material, such as polyurethane, or another suitable polymer having sufficient hardness. In some embodiments, the hardness may be about 55 Shore A to about 65 Shore A. The contact portion 700 may be coupled to the support portion 705 by an adhesive, such as s pressure sensitive adhesive, epoxy, or other suitable adhesive. Likewise, the polishing pad assembly 125 may be adhered to the flexible membrane 410 by a suitable adhesive. In some embodiments, the support portion 705 of the polishing pad assembly 125 is disposed in a recess 710 formed in the flexible membrane 410.

In some embodiments, a thickness 715 of the flexible membrane 410 is about 1.45 mm to about 1.55 mm. In some embodiments a length 720 of the support portion 705 is about 4.2 mm to about 4.5 mm. In the embodiment shown, where the contact portion 700 is circular, a diameter 730 of the contact portion 700 may be about 5 mm. However, in other embodiments, the contact portion 700 may have a different shape and/or a different size depending on factors such as die size and/or the amount of removal that is desired. In some examples, the diameter 730 of the contact portion 700 may be about 2 mm, about 3 mm, about 5 mm up to about 10 mm, or larger, including increments between about 2 mm to about 10 mm.

Figure 8C:
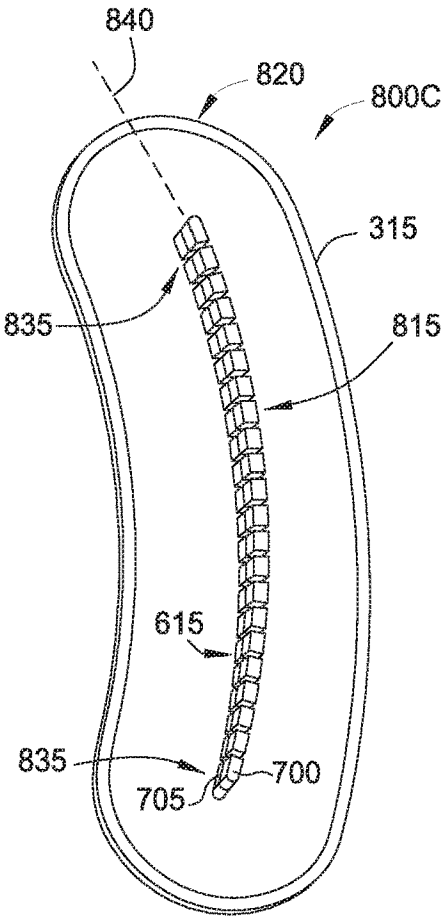
FIGS. 8A-8C are isometric bottom views of various housing assemblies for embodiments of polishing pad assemblies that may form the housing base of the polishing head shown in FIGS. 3-6.
Figure 8B:
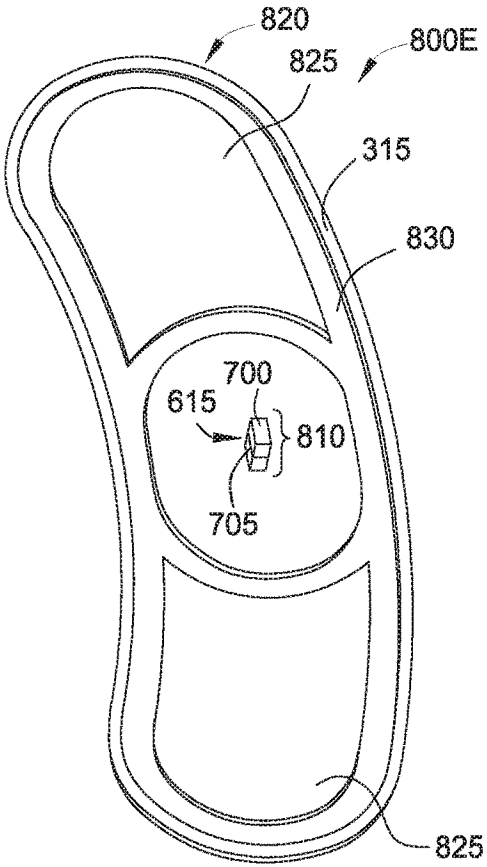
Figure 8A:
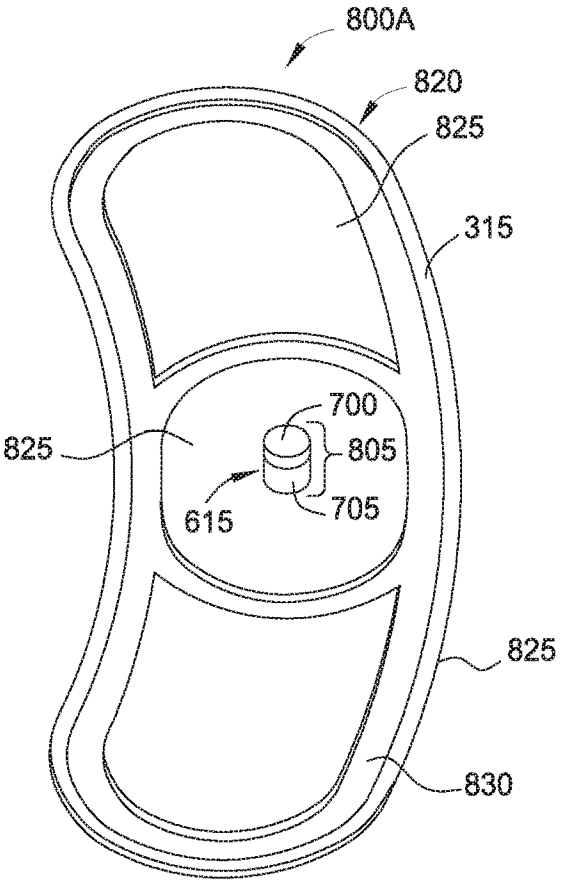

FIGS. 8A-8C are isometric bottom views of various housing assemblies 800A-800C for polishing pad assemblies 805, 810 and 815 that may form the housing base 315 of the polishing head 300 shown in FIGS. 3-6. For example, the housing bases 315 of the housing assemblies 800A, 800C may be coupled to the wall 605 shown in FIG. 6 and an exterior surface 820 (that opposes the interior surface 610 of FIG. 6) would face the substrate (not shown). The polishing pad assemblies 805, 810 and 815 are disposed through the opening 615 formed in the respective housing bases 315, and each include a contact portion 700 and a support portion 705 as described in FIG. 7.

FIG. 8A shows a polishing pad assembly 805 that may be similar to the polishing pad assembly 125 described above. However, the exterior surface 820 of the housing base 315 may include a plurality of raised regions 825 as well as recessed portions 830. The raised regions 825 may be areas of the housing base 315 that is thicker in cross-section relative to the recessed portions 830. Alternatively, the raised regions 825 and the recessed portions 830 have a cross-sectional thickness that is substantially the same. The housing base 315 of the housing assembly 800B may include the raised regions 825 and recessed portions 830.

FIG. 8B shows a housing assembly 800B that is substantially similar to the housing assembly 800A with the exception of a polishing pad assembly 810 having a different shape. In this embodiment, the polishing pad assembly 810 is polygonal (i.e., rectangular). A surface area of the contact portion 700 may be sized according to the size of a die to be polished. While a single polishing pad assembly 810 is shown, there may be more than one polishing pad assembly 810, such as three or four in total or on each side of the polishing pad assembly 810.

FIG. 8C shows a housing assembly 800C that includes another embodiment of a polishing pad assembly 815 that comprises a plurality of pad assembly posts 835 disposed through one or more openings 615 formed in the housing base 315. Each of the pad assembly posts 835 may include a contact portion 700 and a support portion 705 similar to the other polishing pad assemblies described herein. In some embodiments as shown, the pad assembly posts 835 may positioned along an arc 840. The polishing pad assembly 815 according to this embodiment may be utilized to polish a radial zone of a substrate (nor shown) that may be non-uniform.

FIGS. 9A-10B are various views showing different embodiments of polishing heads that may be utilized as one or more of the polishing heads 222 shown in FIGS. 2A and 2B.

Figure 9A:
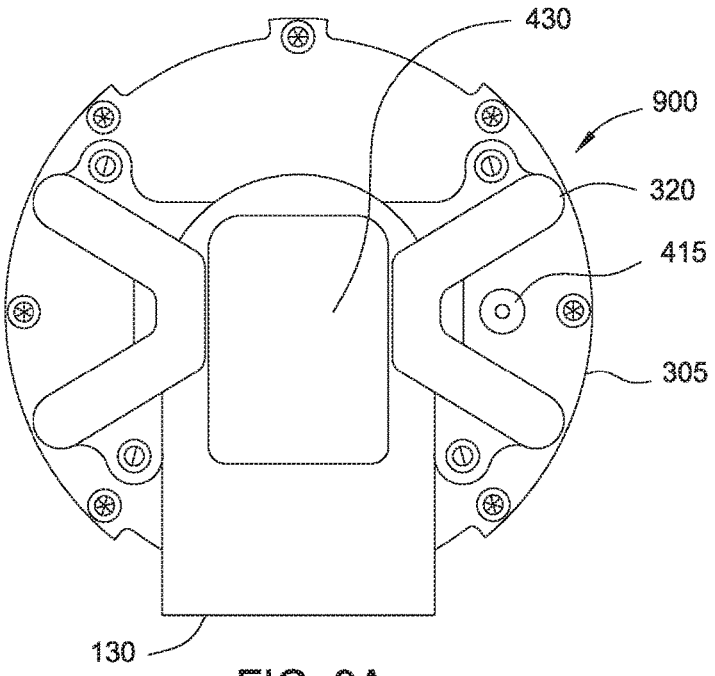
FIGS. 9A-10B are various views showing different embodiments of polishing heads that may be utilized as one or more of the polishing heads shown in FIGS. 2A and 2B.
Figure 9B:
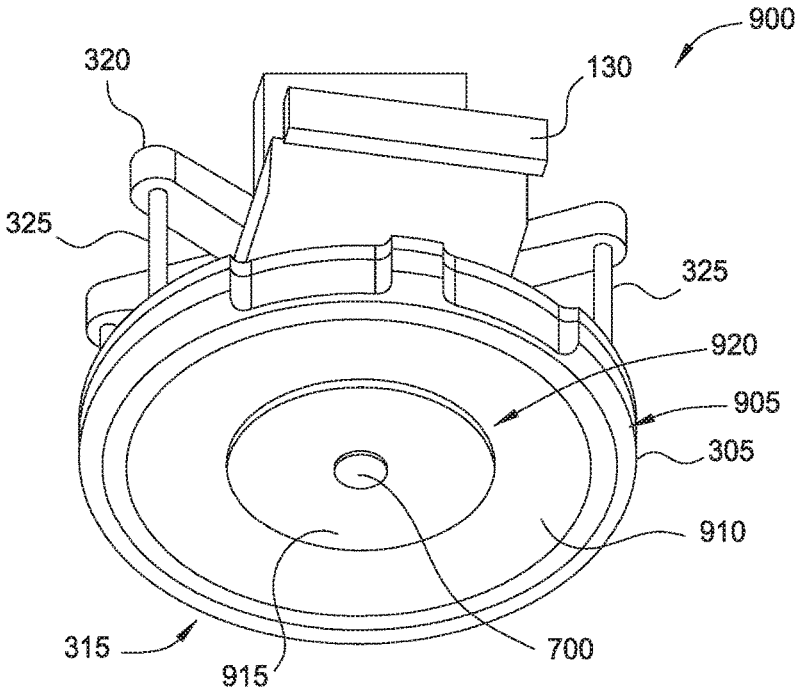

FIG. 9A is a top plan view of a polishing head 900 and FIG. 9B is a bottom perspective view of the polishing head 900 of FIG. 9A. The polishing head 900 according to this embodiment includes a contact portion 700 that is circular. In some embodiments, the polishing head 900 includes a support member 905 (i.e., the housing base 315) having a first region 910 and a second region 915. The second region 915 may surround the first region 910. The first region 910 may include a flexible property that is different than a flexible property of the second region 915. For example, the first region 910 may be less flexible than the second region 915, or vice versa. The first region 910 and the second region 915 may extend at different distances from a surface of the housing 305. For example, the second region 915 may be raised from a surface of the first region 910. In some embodiments, the support member 905 includes a transition region 920 disposed between the first region 910 and the second region 915. The transition region 920 may have a flexible property that is different than the flexible property of one or both of the first region 910 and the second region 915. For example, the transition region 920 may be thinner in cross-section (as compared to a cross-section of the first region 910 and/or the second region 915) such the second region 915 flexes relative to the first region 910. The transition region 920 may also be a step region between surface of the first region 910 and the second region 915. In some embodiments, the support member 905 is integral (i.e., does not include the opening 615 (described in FIG. 6)) such that an internal surface of the support member 905 is in fluid communication with the pressure chamber 400 (shown in FIG. 4) and/or in contact with the rotor 515 (shown in FIG. 5). Although not shown, the polishing head 900 may be utilized with portions of any of the polishing pad assemblies 805, 810 and 815 of FIGS. 8A-8C (with or without the opening 615).

Figure 10A:
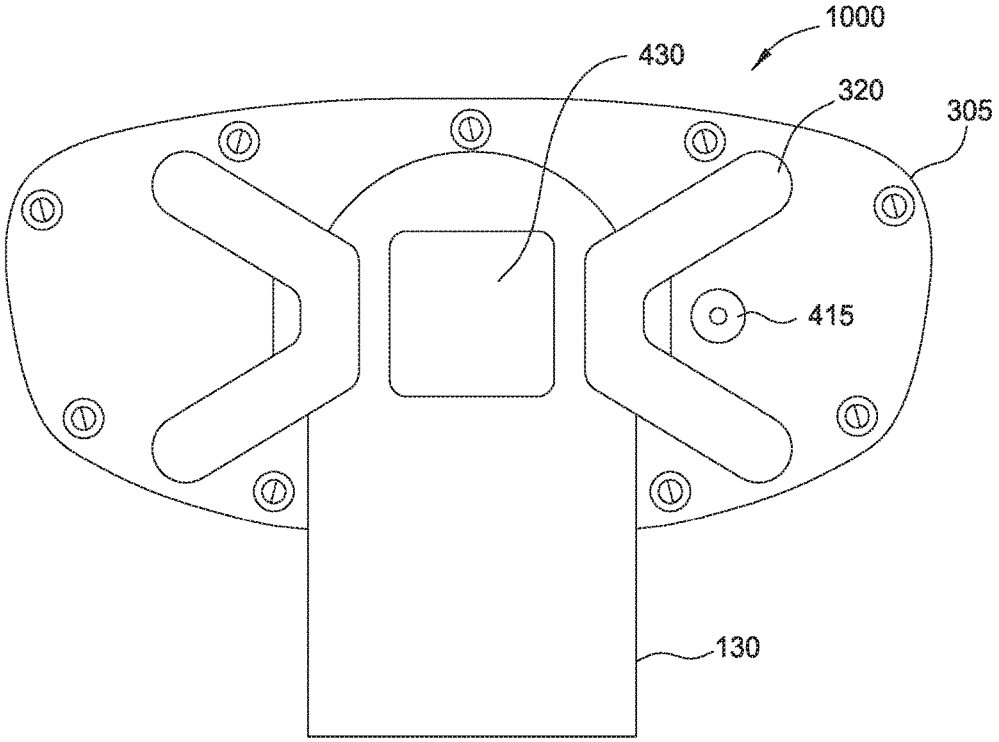
Figure 10B:
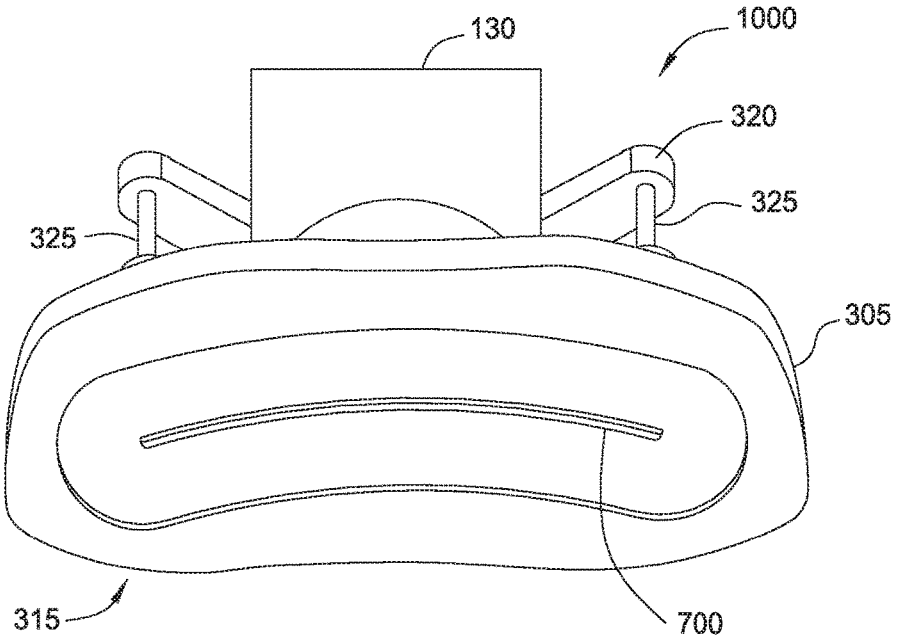

FIG. 10A is a top plan view of a polishing head 1000 and FIG. 10B is a bottom perspective view of the polishing head 1000 of FIG. 10A. The polishing head 1000 according to this embodiment includes a contact portion 700 that is arc-shaped. Although not shown, the polishing head 1000 may be utilized with portions of any of the polishing pad assemblies 805, 810 and 815 of FIGS. 8A-8C (with or without the opening 615).

While the foregoing is directed to embodiments of the present disclosure, other and further embodiments of the disclosure may be devised without departing from the basic scope thereof, and the scope thereof is determined by the claims that follow.

The invention claimed is:

1. A polishing module, comprising:
a chuck having a substrate receiving surface and a perimeter; and
a polishing pad assembly positioned about the perimeter of the chuck, wherein the polishing pad assembly is coupled to an actuator that provides movement of the polishing pad assembly in one or more of a sweep direction, a radial direction, and an oscillating mode relative to the substrate receiving surface and are limited in radial movement to about less than one-half of the radius of the chuck as measured from the perimeter of the chuck, and the polishing pad assembly comprises:
a polishing head that is configured to support a polishing pad; and
a pad actuator assembly that is configured to cause at least a portion of the polishing pad to translate relative to the polishing head, wherein the polishing head includes a housing having an interior wall, and a rotor of the actuator assembly intermittently contacts the interior wall of the housing.

2. The module of claim 1, wherein the polishing head is circular.

3. The module of claim 2, wherein the polishing pad assembly is circular.

4. The module of claim 2, wherein the polishing pad assembly is polygonal.

5. The module of claim 2, wherein the polishing pad assembly comprises a plurality of pad assembly posts.

6. The module of claim 1, wherein the polishing head is arc-shaped.

7. The module of claim 6, wherein the polishing pad assembly is circular.

8. The module of claim 6, wherein the polishing pad assembly is polygonal.

9. The module of claim 6, wherein the polishing pad assembly comprises a plurality of pad assembly posts.

10. A polishing module, comprising:
a chuck having a substrate receiving surface and a perimeter;
a polishing head disposed about the perimeter; and
a polishing pad assembly disposed in a housing that is coupled to the polishing head, wherein the polishing head is coupled to an actuator configured to provide movement of the polishing pad assembly in a sweep direction and a radial direction that is less than about one-half of a radius of the chuck, and the polishing head includes a pad actuator assembly that includes a pad actuator that has a rotating shaft and a rotor that intermittently contacts the housing to provide oscillating movement between the polishing pad assembly and the housing.

11. The module of claim 10, wherein the polishing head is circular.

12. The module of claim 11, wherein the polishing pad assembly is circular.

13. The module of claim 11, wherein the polishing pad assembly is polygonal.

14. The module of claim 11, wherein the polishing pad assembly comprises a plurality of pad assembly posts.

15. The module of claim 10, wherein the polishing head is arc-shaped.

16. The module of claim 15, wherein the polishing pad assembly is circular.

17. The module of claim 15, wherein the polishing pad assembly is polygonal.

18. The module of claim 15, wherein the polishing pad assembly comprises a plurality of pad assembly posts.

19. A polishing module, comprising:
a chuck having a substrate receiving surface and a perimeter; and
a polishing head positioned about the perimeter of the chuck, the polishing head being coupled to a housing having a polishing pad assembly disposed thereon, wherein:
the polishing head is coupled to an actuator that provides movement of the polishing pad assembly in a sweep direction and a radial direction that is less than about one-half of a radius of the chuck, and the polishing head includes a motor that is coupled to a shaft and a rotor that intermittently contacts the housing to provide oscillating movement between the polishing pad assembly and the housing;
the polishing head is circular; and
the polishing pad assembly is circular or polygonal.

* * * * *